US006033699A

United States Patent [19]

Vincenzi

[11] Patent Number: 6,033,699

[45] Date of Patent: Mar. 7, 2000

[54] PACKING FOR FRIABLE OVEN PRODUCTS

[75] Inventor: Giuseppe Vincenzi, S.Giovanni Lupatoto, Italy

[73] Assignee: Vicenzi Biscoti S.p.A., S. Giovanni Lupatoto, Italy

[21] Appl. No.: 09/149,057

[22] Filed: Sep. 8, 1998

[30] Foreign Application Priority Data

Sep. 15, 1997 [IT] Italy ..... VR970047 U

[51] Int. Cl.[7] ..... A21D 10/02; B65D 85/00

[52] U.S. Cl. ..... 426/106; 426/112; 426/115; 426/128

[58] Field of Search ..... 426/112, 115, 426/124, 128, 106

[56] References Cited

U.S. PATENT DOCUMENTS

| | | | |
|---|---|---|---|
| 2,494,446 | 1/1950 | Moore | 206/45.33 |
| 4,548,852 | 10/1985 | Mitchell | 426/111 |
| 5,230,914 | 7/1993 | Akervik | 426/107 |
| 5,393,539 | 2/1995 | Reskow | 426/124 |
| 5,429,833 | 7/1995 | Wyslotsky | 426/122 |
| 5,667,827 | 9/1997 | Breen et al. | 426/129 |

*Primary Examiner*—David Lacey
*Assistant Examiner*—Drew Becker
*Attorney, Agent, or Firm*—Browdy and Neimark

[57] ABSTRACT

The present invention relates to a packaging for friable oven products substantially comprising a container (2) provided with an opening (3) and a supporting edge (13) extending so as to project from the side surface (8) of the container (2), a lid (5) having a shape corresponding to that of the opening (3) and surrounded by a bearing edge (14) designed to engage with the supporting edge (13) when the lid (5) is arranged in the closed position on top of the container (2), and an external sealed wrapping (6) designed to keep the supporting edge (13) in abutment against the bearing edge (14), thereby preventing the friable oven products (4) from undergoing movements which may damage their intact condition. For this purpose, the lid (5) is arranged, when closed on top of the container (2), at a distance (D) from the base of the latter, substantially equal to the height occupied by the friable oven products (4) inside the container (2).

12 Claims, 4 Drawing Sheets

PACKING FOR FRIABLE OVEN PRODUCTS

BACKGROUND OF THE INVENTION

1. Field of the Invention

The present invention relates to a packaging for friable oven products.

In particular it must be stated that the packaging in question is intended to be advantageously used in the food packaging industry in order to improve conservation of the physical integrity of friable oven products such as, for example, the various varieties of puff-pastry cookies.

More particularly, the said packaging is able to ensure the substantial immobilization of the friable products contained inside it, thereby ensuring safe transportation thereof without impairing their intact condition.

2. Description of the Prior Art

At present, in accordance with the known art, it is commonly envisaged packaging friable oven products in containers without a lid (generally plastic trays) inserted inside a wrapping designed to ensure isolation thereof from the external environment.

As is known, this technique in practice has proved to be not very suitable for keeping the friable products intact since the latter retain a certain freedom of movement inside the containers and in so doing may be subject to breakage or deterioration and their intact surface condition may be adversely affected. The result of this is that, especially during transportation over long distances or subject to particular vibrations, the friable products reach their destination damaged and ruined from the point of view of their appearance.

This drawback is fully evident in the case where the friable product consists of puff pastries, ie. cookies which are notoriously fragile and friable. These cookies in fact are often present in shops in packaging of the type mentioned above and therefore are often on display to the public in an imperfect condition surrounded by numerous crumbs.

SUMMARY OF THE INVENTION

The main object of the present invention is therefore that of overcoming the drawbacks associated with the packaging for friable oven products of the known type by providing a new type of packaging which allows immobilization of the friable oven products inside containers, allowing the transportation thereof without damaging their intact condition.

A further object of the present invention is that of providing a practical and constructionally simple packaging.

These objects, along with others, are all achieved by the packaging in question which comprises substantially a container designed to receive a plurality of friable oven products and provided with an opening and a supporting edge extending so as to project from the side surface of the container, a lid having a shape corresponding to that of the opening and surrounded by a bearing edge designed to engage with the supporting edge when the lid is arranged in the closed position on top of the container, and an external sealed wrapping designed to keep the supporting edge in abutment against the bearing edge, thereby preventing the friable oven products from undergoing movements which may damage their intact condition.

In accordance with a further characteristic feature of the invention, the lid is arranged, when closed on top of the container, at a distance from the base of the latter, substantially equal to the height occupied by the friable oven products inside the container.

BRIEF DESCRIPTION OF THE DRAWINGS

The technical features of the invention, in accordance with the aforementioned objects, may be determined from the contents of the claims indicated below and the advantages thereof will emerge clearly from the detailed description which follows, with reference to the accompanying drawings illustrating a purely exemplary and non-limiting embodiment thereof, in which:

DETAILED DESCRIPTION OF THE PREFERRED EMBODIMENTS

Figure 1:
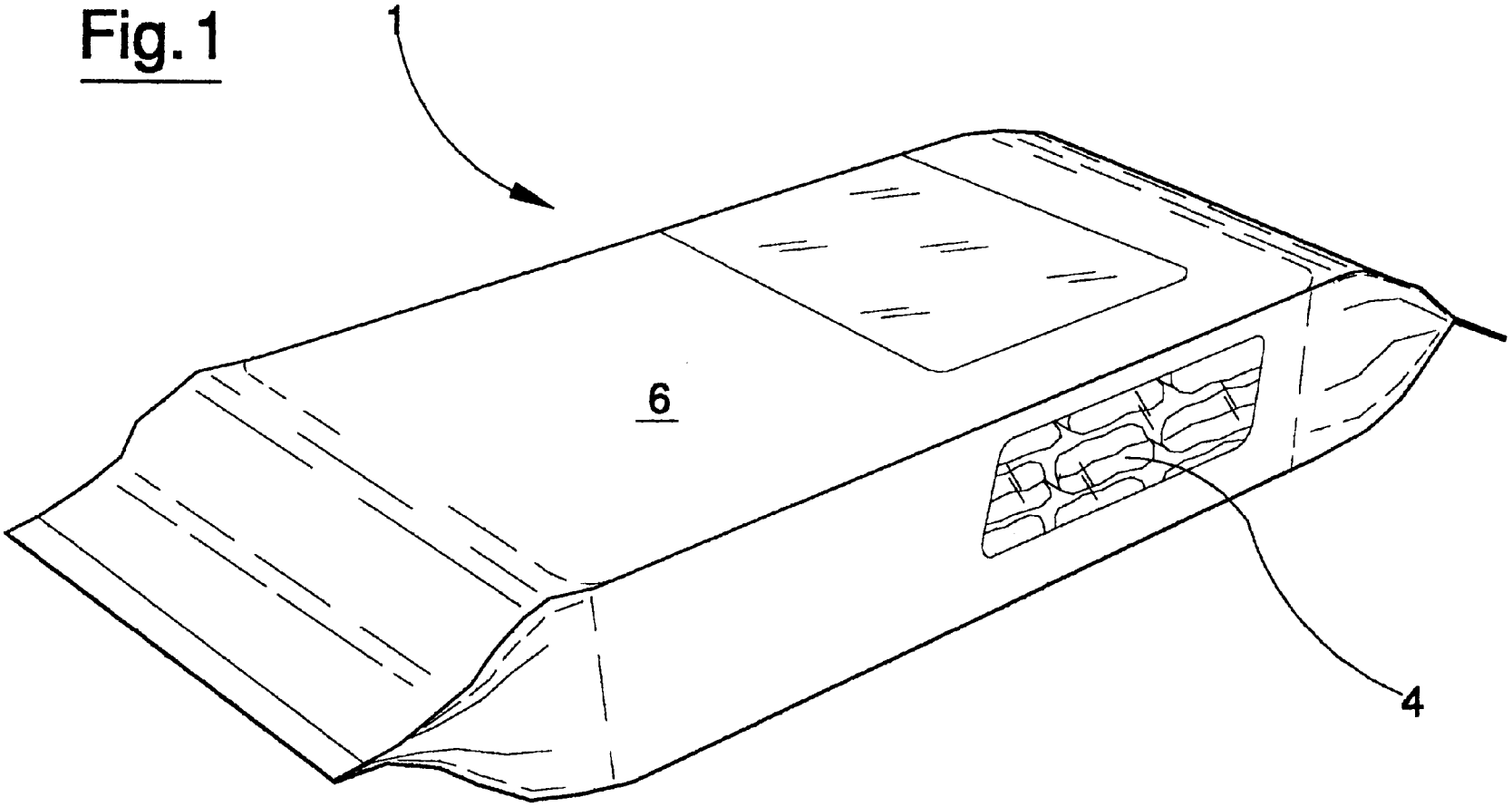
FIG. 1 shows a schematic perspective view of the packaging according to the present invention.

In accordance with the accompanying drawings, 1 denotes in its entirety the packaging for friable oven products according to the present invention.

Said packaging comprises essentially a container 2 provided at the top with an opening 3 and designed to receive a plurality of friable oven products 4, a lid 5 having a shape corresponding to that of the opening 3 of the container 2 and an external wrapping 6 designed to wrap in a sealed manner the closed container 2, together with the lid 5, thus preserving the organoleptic properties of the friable oven products 4.

In the case of the example illustrated in the accompanying figures, the container 2 is shaped substantially in the manner of a parallelepiped and consequently the lid 5 and the opening 3 of the container 2 have the same quadrangular (rectangular) shape.

Figure 6:
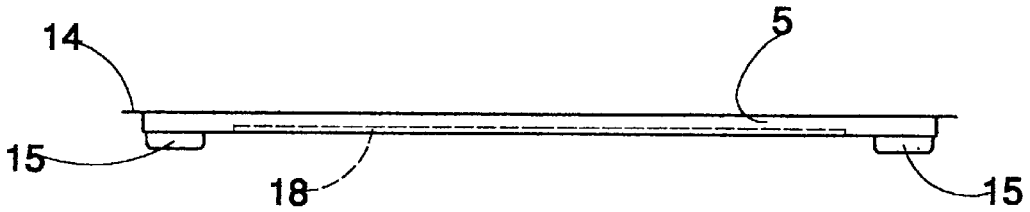
FIG. 6 shows a schematic side view of the lid of the packaging according to FIG. 1.
Figure 5:
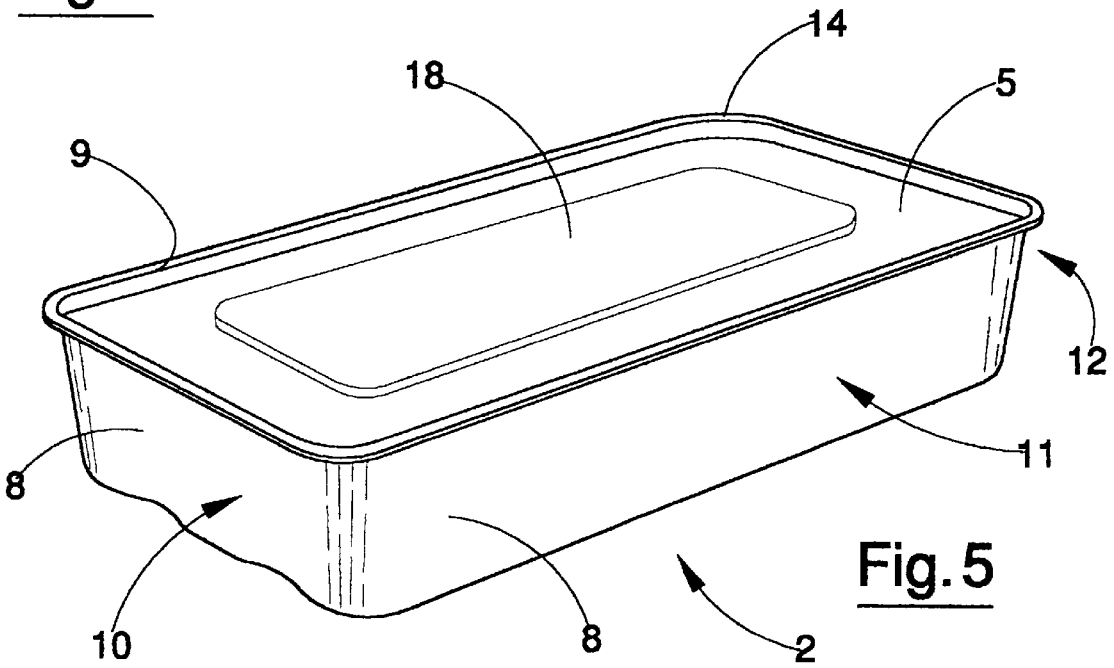
FIG. 5 shows a schematic perspective view of the container with lid of the packaging according to FIG. 1.

As can be seen in particular in FIGS. 5 and 6, the container 2 consists of a rectangular base 7 and a side containment surface 8 connected peripherally to the base 7 along a bottom rim 9 and formed with two short faces 10 and two extended faces 11 connected at right angles in sequence with one another.

Figure 2:
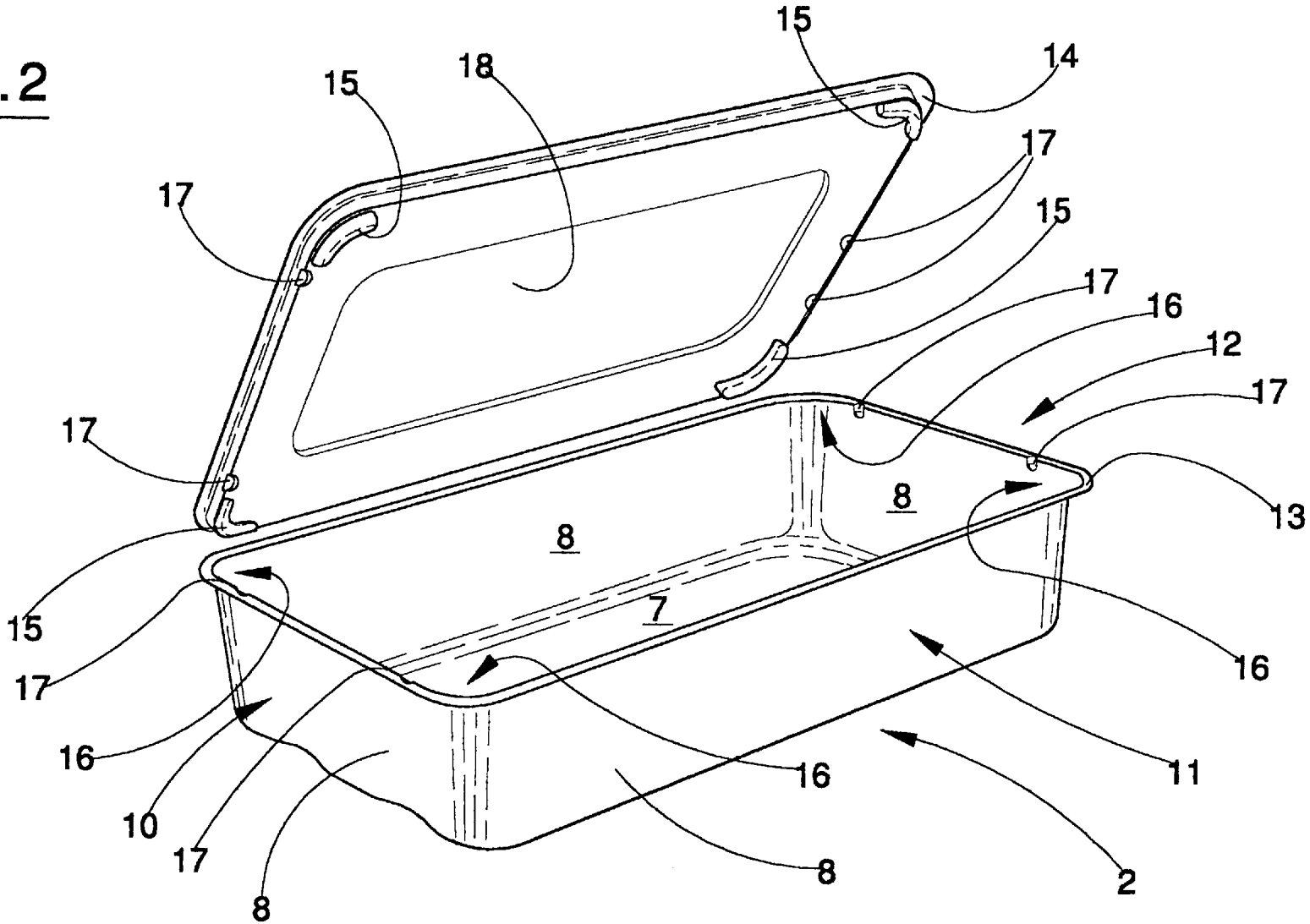
FIG. 2 shows a schematic perspective view of the container of the packaging according to FIG. 1 with the lid raised and without wrapping and products inside it.
Figure 3:
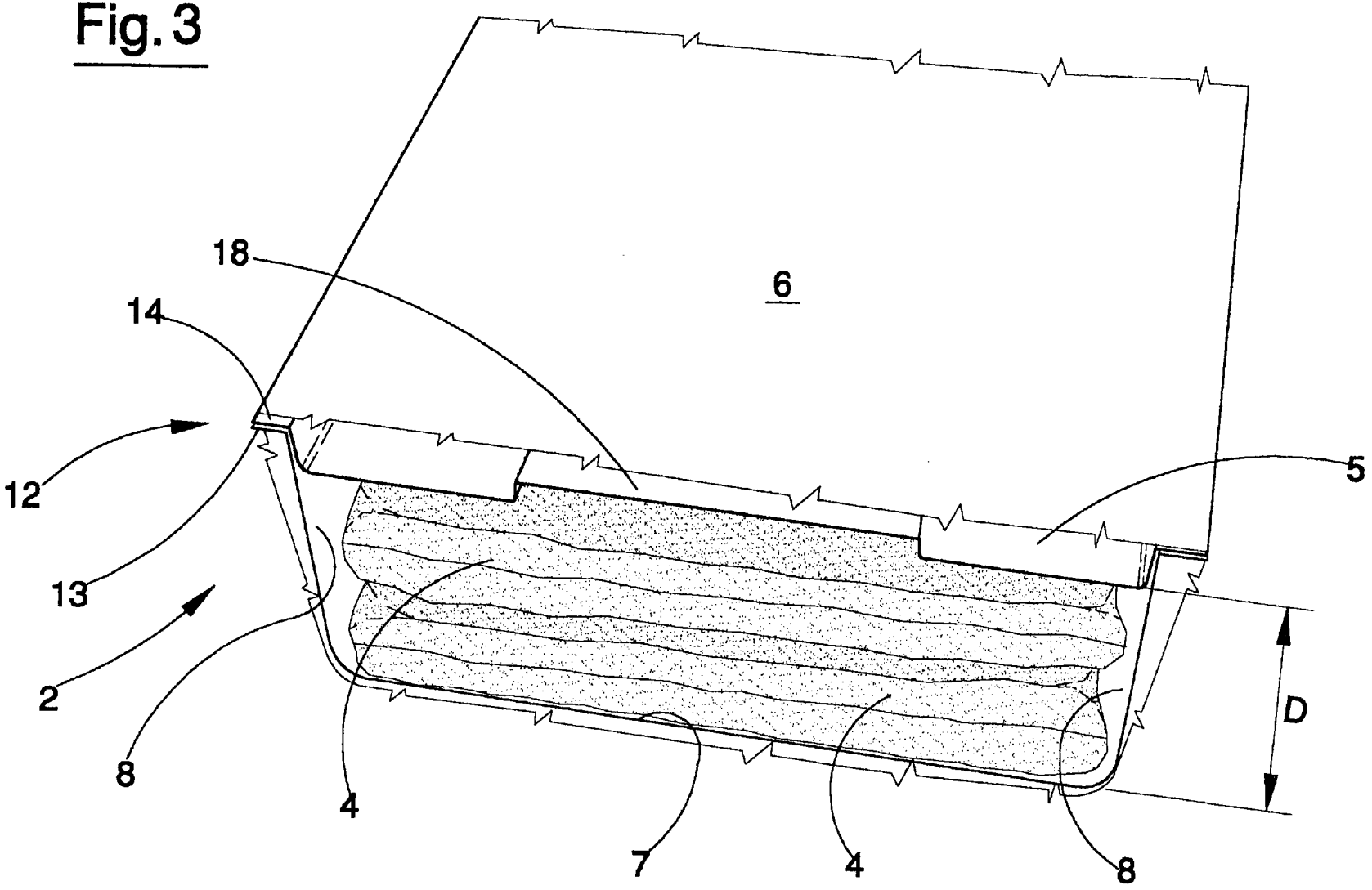
FIG. 3 shows a schematic perspective view of the packaging according to FIG. 1 with some parts removed so that other parts may be more clearly visible.

With reference to FIGS. 1 and 2, the side containment surface 8 is provided at the top with a free rim 12 designed to delimit perimetrally the opening 3 of the container 2. In the region of the abovementioned free rim 12 the container 2 has a supporting edge 13 extending perpendicularly so as to project from the side surface 8. Similarly (see FIGS. 3 and 4), the lid 5 is surrounded by a bearing edge 14 designed to engage with the supporting edge 13 of the container 2 when the lid 5 is placed in the closed position on the container 2. As seen in FIG. 3, the external wrapping (6) is spaced apart from the lid (5).

In the example illustrated in FIG. 5, the bearing edge 14 and the supporting edge 13, once they have been joined together, lie substantially in a same horizontal location.

More particularly, the lid 5 is located, once placed in the closed position on the container 2, at a distance D from the base 7, equal to the height occupied by the friable oven products 4 placed inside the container 2. In this way, since the external wrapping 6 of the packaging 1 keeps the supporting edge 13 of the container 2 constantly in abutment against the bearing edge 14 of the lid 5, it is managed to prevent the friable oven products 4 from performing movements which may damage their intact condition. In fact, by so doing, the oven products 4 are held vertically in position between the base 7 of the container 2 and the lid 5, as well as, obviously, being retained by the side surface 8 of the container 2.

In particular, in the example illustrated in FIGS. 1 and 2, the lid 5 is arranged closed on the container 2 at a distance D substantially equal to the height of two layers of oven products 4 which, as can be seen, in this case consist of puff pastries.

Figure 4:
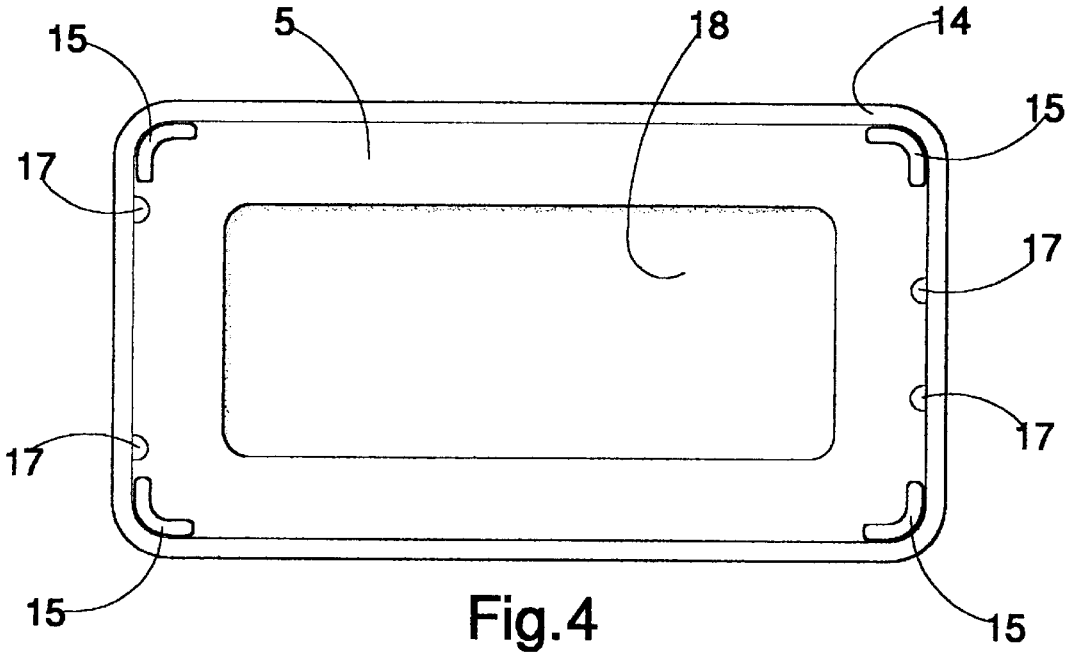
FIG. 4 shows a schematic top plan view of the container with lid of the packaging according to FIG. 1.

In accordance with FIGS. 3 and 4, the lid 5 has, at the four corners, projections 15 directed towards the inside of the container 2.

These projections 15 are obtained during molding of the lid 5 and therefore form a single body therewith. Observing FIG. 5, it can be noted that said projections are inserted into corresponding counter-shaped cavities 16 formed in the corners of the container 2 along the free rim 12 of the latter. Projections 15 and cavities 16 perform substantially the function of ensuring a stable connection between lid 5 and container 2.

Advantageously, air breather grooves have been formed along the free rim 12 of the container 2 and the peripheral edge of the lid 5 so as to allow rapid closure of the lid 5 on the container 2.

Finally a projecting area 18 (directed in the example illustrated in the accompanying drawings towards the outside of the container 2) is formed centrally on the lid 5, said projecting area being designed to provide the lid 5 with elasticity, allowing compression thereof in a gradually resilient manner onto the friable oven products 4.

Obviously it is possible to provide a plurality of areas 18, projecting with respect to one another, designed to provide the lid 5 with a greater degree of elasticity so as to keep the friable oven products resiliently compressed inside the packaging 1, once the lid 5 has been closed.

What is claimed:

1. A packaging for friable oven products, comprising: a container (2) having a plurality of friable oven products and is formed by at least one base (7) and by at least one side containment surface (8) connected peripherally to said base (7) and provided with a free rim (12) designed to delimit perimetrally an opening (3) and having a supporting edge (13) extending so as to project from said at least one side containment surface (8); a lid (5) having a shape corresponding to that of said opening (3) of the container (2) and being surrounded by a bearing edge (14) designed to engage with said supporting edge (13) when said lid (5) is arranged in the closed position on top of said container (2), said lid (5) being arranged in said closed position at a distance (D) from said at least one base (7), substantially equal to the height occupied by the friable oven products (4) inside the container (2); an external wrapping (6) designed to preserve the organoleptic properties of said friable oven products (4) and to keep said supporting edge (13) constantly in abutment against said bearing edge (14), thereby preventing the friable oven products (4) from undergoing movements which may damage the intact condition thereof.

2. The packaging as claimed in claim 1, wherein said lid (5) is arranged, when closed on said container (2), at a distance (D) substantially equal to the overall height of a multiplicity of layers of said friable oven products (4).

3. The packaging as claimed in claim 1, wherein said lid (5) has projections (15) directed, in the closed condition of said lid (5), inside the container (2), forming a single body therewith, being arranged peripherally and designed to engage with corresponding cavities (16) which are counter-shaped with respect thereto and are formed along the free rim (12) of said container (2).

4. The packaging as claimed in claim 3, wherein said lid (5) and the opening (3) of said container (2) have substantially a similar quadrangular shape and in that said projections (15) and said cavities (16) are formed at corners respectively of said lid (5) and said container (2).

5. The packaging as claimed in claim 1, wherein air breather grooves (17) designed to allow rapid closure of the lid (5) on the container (2) are formed on said at least one side surface (8) along the free rim (12) of the container (2).

6. The packaging as claimed in claim 1, wherein air breather grooves (17) designed to allow rapid closure of the lid (5) on the container (2) are formed in a peripheral position on said lid (5).

7. The packaging as claimed in claim 1, wherein said external wrapping (6) ensures isolation of the friable oven products (4) from the external environment.

8. The packaging as claimed in claim 1, wherein said supporting edge (13) of the container (2) extends perpendicularly with respect to the extension of said at least one side surface (8) of the container (2).

9. The packaging as claimed in claim 1, wherein said supporting edge (13) of the container (2) and said bearing edge (14) of the lid (5) are counter-shaped with respect to one another.

10. The packaging as claimed in claim 1, wherein a total container height is greater than the distance (D), whereby the external wrapping (6) is spaced apart from the lid (5).

11. A packaging for friable oven products, comprising:

a container (2) adapted to receive a plurality of friable oven products and formed by at least one base (7) and by at least one side containment surface (8) connected peripherally to said at least one base (7) and provided with a free rim (12) designed to delimit perimetrally an opening (3) and having a supporting edge (13) extending so as to project from said side surface (8);

a lid (5) having a shape corresponding to that of said opening (3) of the container (2) and being surrounded by a bearing edge (14) designed to engage with said supporting edge (13) when said lid (5) is arranged in the closed position on top of said container (2), said lid (5) being arranged in said closed position at a distance (D) from said at least one base (7);

an external wrapping (6) designed to preserve the organoleptic properties of the friable oven products (4) and to keep said supporting edge (13) constantly in abutment against said bearing edge (14), thereby preventing the friable oven products (4) from undergoing movements which may damage the intact condition thereof;

wherein at least one projecting area (18) designed to provide the lid (5) with elasticity is formed on said lid (5), so as to compress in a gradually resilient manner the friable oven products (4).

12. The packaging as claimed in claim 11, wherein the at least one projecting area further comprises a plurality of areas (18) projecting with respect to one another and designed to provide the lid (5) with elasticity is formed on said lid (5).

* * * * *